US007063235B2

(12) United States Patent
Auer

(10) Patent No.: US 7,063,235 B2
(45) Date of Patent: Jun. 20, 2006

(54) METERING PUMP DISPENSER

(75) Inventor: Günter Auer, Villingen-Schwenningen (DE)

(73) Assignee: MegaPlast GmbH & Co. KG, Schwenningen (DE)

( * ) Notice: Subject to any disclaimer, the term of this patent is extended or adjusted under 35 U.S.C. 154(b) by 65 days.

(21) Appl. No.: 10/808,045

(22) Filed: Mar. 24, 2004

(65) Prior Publication Data

US 2004/0188464 A1 Sep. 30, 2004

(30) Foreign Application Priority Data

Mar. 25, 2003 (DE) ..... 203 04 731 U

(51) Int. Cl.
*B05B 7/04* (2006.01)

(52) U.S. Cl. ..... 222/135; 222/145.1

(58) Field of Classification Search ..... 222/135, 222/145.1, 209, 386, 145.5, 183
See application file for complete search history.

(56) References Cited

U.S. PATENT DOCUMENTS 5,042,694 A * 8/1991 Birmelin ..... 222/145.3
5,152,434 A * 10/1992 Birmelin ..... 222/207
5,224,627 A * 7/1993 Weag ..... 222/135
5,351,862 A * 10/1994 Weag ..... 222/145.3
5,819,990 A * 10/1998 Cimentepe et al. ..... 222/207
6,341,717 B1 * 1/2002 Auer ..... 222/135

FOREIGN PATENT DOCUMENTS

DE 200 19 540 U1 2/2001
DE 101 10 888 A1 10/2001

* cited by examiner

*Primary Examiner*—Michael Mar
*Assistant Examiner*—Melvin A Cartagena
(74) *Attorney, Agent, or Firm*—McGlew & Tuttle, P.C.

(57) ABSTRACT

A metering pump made of plastic for the metered dispensing of liquid and/or pasty media from a bottle-like container, can-like container or tube-like container with a follower piston. A pump chamber delivering the medium is connected via a suction valve with the container and has as the pumping member an elastic bellows that forms the pump chamber and is arranged between a dimensionally stable lower housing part and a likewise dimensionally stable upper housing part that is telescopically movable in relation thereto. The upper housing part has the discharge opening, which is connected via a discharge channel and a discharge valve with the pump chamber. The bellows has an upper ring collar sealingly surrounding a ring wall of the upper housing part. The ring wall is provided with a displacement piston that has a smaller diameter and protrudes into the bellows. To make it possible to accurately meter the quantities of the medium to be pumped that are to be metered, provisions are made for the displacement piston to be closed at its lower end and to be provided in the upper end area of the pump chamber with at least one passage opening, which connects the pump chamber with the discharge valve.

16 Claims, 6 Drawing Sheets

METERING PUMP DISPENSER

CROSS REFERENCE TO RELATED APPLICATIONS

This application claims the benefit of priority under 35 U.S.C. § 119 of German patent application DE 203 04 731 filed Mar. 25, 2003 the entire contents of which are incorporated herein by reference.

FIELD OF THE INVENTION

The present invention pertains to a metering pump made of plastic for the metered dispensing of liquid and/or pasty media from a bottle-, can- or tube-like container with a follower piston, wherein a pump chamber delivering the medium is connected with the container via a suction valve and has as the pumping member an elastic bellows, which forms the pump chamber and is arranged between a dimensionally stable lower housing part and a likewise dimensionally stable upper housing part that is telescopically movable in relation thereto, and wherein the upper housing part has the discharge opening, which is connected via a discharge channel and a discharge valve with the pump chamber, and wherein, furthermore, the bellows sealingly surrounds with an upper ring collar a ring wall of the upper housing part, which ring wall is provided with a displacement piston, which has a smaller diameter and protrudes into the bellows.

BACKGROUND OF THE INVENTION

Metering pumps of this type have been known. They are used for both the metered dispensing of a single medium and the simultaneous metered dispensing of two different media, the medium to be dispensed being accommodated in a container that is or can be connected to the metering pump. There are dispensing devices, so-called dispensers, with two separate storage containers and two metering pumps, which can be actuated together by means of an actuating lever or the like (DE 101 10 888 A1), as well as dispensers in which two different media are accommodated in a single storage container (DE 200 19 540 U1) and are delivered by two separate metering pumps in different metered quantities to a common discharge opening.

The bellows as the pumping member plays functionally the most important role in metering pumps of this type. This bellows also must consist of plastic as an injection-molded part and be able to apply the restoring force for the resetting into the starting position, which is necessary after each working stroke, in order to draw from the storage container the quantity of medium that had been dispensed during the working stroke into the pump chamber in the process. The bellows must therefore have a certain minimum size in terms of both its axial length and the number of elastic bellows folds.

However, this also results in a corresponding minimum size of the interior space of the bellows that forms the annular chamber, which corresponds in some applications to a multiple of the quantity to be dispensed during each stroke of the pump. To reduce the volume of the pump chamber, which is determined by the minimum size of the bellows, a displacement piston, which protrudes into the upper part of the pump chamber or the bellows, is already provided in these prior-art metering pumps.

Due to the reduction achieved in the volume of the pump chamber, an improvement of the suction process is also achieved during the first pump strokes, during which the bellows is still filled first with air.

However, the displacement piston in these prior-art metering pumps has a central opening at its lower front side, through which the medium to be pumped is pumped to the dispensing opening to the discharge valve or through the said discharge valve. A residual air cushion is therefore inevitably formed around the displacement piston in the upper area of the bellows in these prior-art metering pumps. The consequence of this compressible air cushion may be that the quantities dispensed during the individual pump strokes will be different.

The phenomenon of the different dispensed quantities is not noticed by the user in case of an individual metering pump, which delivers only a single medium.

However, different dispensed quantities are perceptible in case of dispensers with two metering pumps and storage containers arranged next to each other, from which medium is being delivered separately, with metering pumps that have completely identical design and also work in the same manner if the axial positions of the two follower pistons are different already after a number of pump strokes in case of transparent or translucent container walls. In addition, this drawback can also be recognized from the fact that one storage container is pumped empty sooner than the other one.

SUMMARY OF THE INVENTION

The basic object of the present invention is to provide a metering pump of the type described in the introduction, which consists of a plastic and can be mounted automatically, which makes it possible to accurately meter the dispensed quantities of the medium to be pumped.

This object is accomplished according to the present invention in that the displacement piston is closed at its lower end and is provided in the upper end area of the pump chamber with at least one passage opening, which connects the pump chamber with the discharge valve.

It is ensured by the design of the displacement piston according to the present invention that no air cushion can be formed any longer in the upper, i.e., outlet-side end area of the bellows or the displacement piston, and the entire cavity of the bellows, i.e., the entire pump chamber, is filled with the incompressible medium, which may have a pasty or liquid consistency. As a consequence of this, the dispensed quantities that are delivered to the discharge opening during each pump stroke will also be equal during equal pump strokes, and such quantities will again be drawn in from the storage container during the restoring movement of the bellows.

Manufacturing technological as well as assembly technological advantages may be achieved with a displacement piston having a cavity that is open on the top side.

Advantages may be achieved with the displacement piston forming a separate cavity that is open on the top side with the ring wall surrounded by the ring collar of the bellows, which cavity has a ring collar within its ring wall above the passage opening(s) for sealingly accommodating a valve nipple of the discharge valve, which valve nipple is open at the bottom.

Advantages may be achieved with the valve nipple having a plug, which is connected to it by the rib-like webs and sealingly protrudes under the passage opening(s) into the cavity of the displacement piston.

Advantages may be achieved with the displacement piston being made concentrically integrally in one piece with an underside radial wall ring of the ring wall.

Advantages may be achieved with passage opening(s) formed based on the displacement piston being provided on the outside with at least one axial groove with a radial depth ending radially within the internal diameter of the ring collar.

Advantages may be achieved with the ring wall provided with the displacement piston having at its upper end a torus lockingly fastened to centering ribs. The ribs are arranged in a ring-like pattern around the valve nipple and are a one-piece part of a valve seat housing together with the valve nipple.

Advantages may be achieved with the valve seat housing being lockingly inserted into a hood body in a positive-locking manner and forming the upper housing part together with same.

The present invention will be explained in greater detail below on the basis of a so-called co-dispenser, which is shown in the drawings and is provided with two metering pumps and storage containers. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

FIG. 17#a is a sectional view XVIIa—XVIIa from FIG. 17;

DESCRIPTION OF THE PREFERRED EMBODIMENT

Figure 1:
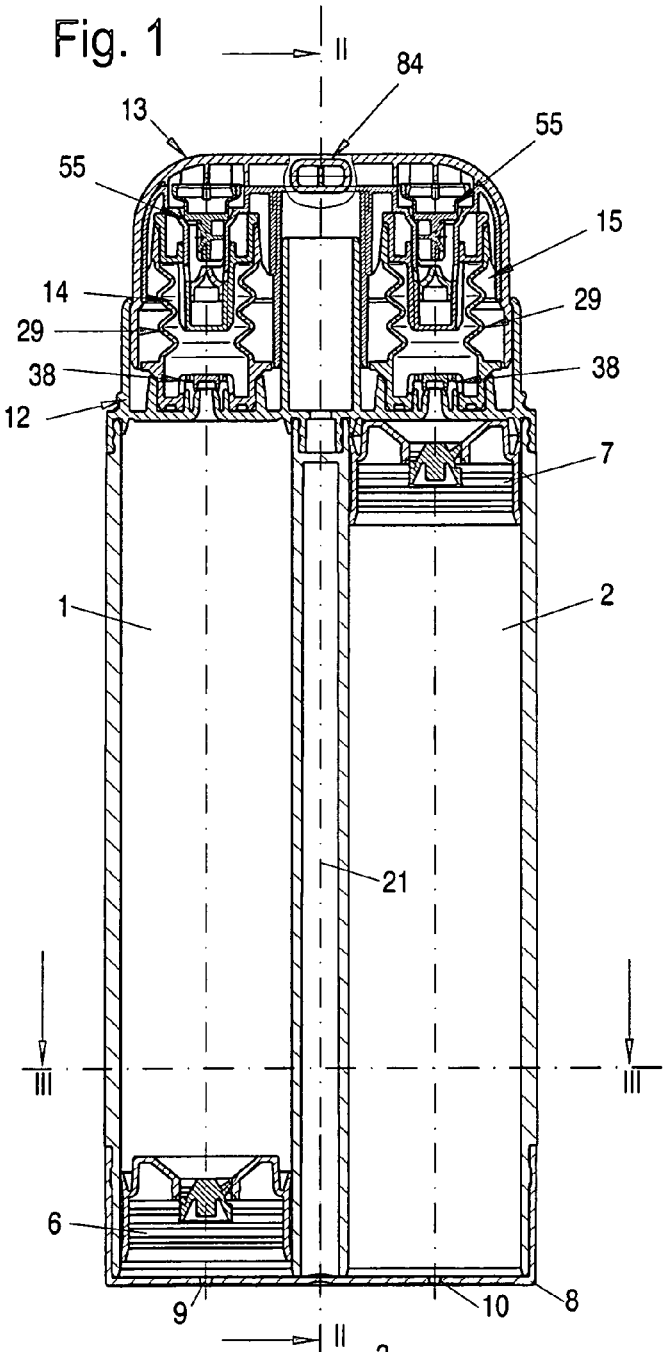
FIG. 1 is a sectional view of a co-dispenser.
Figure 2:
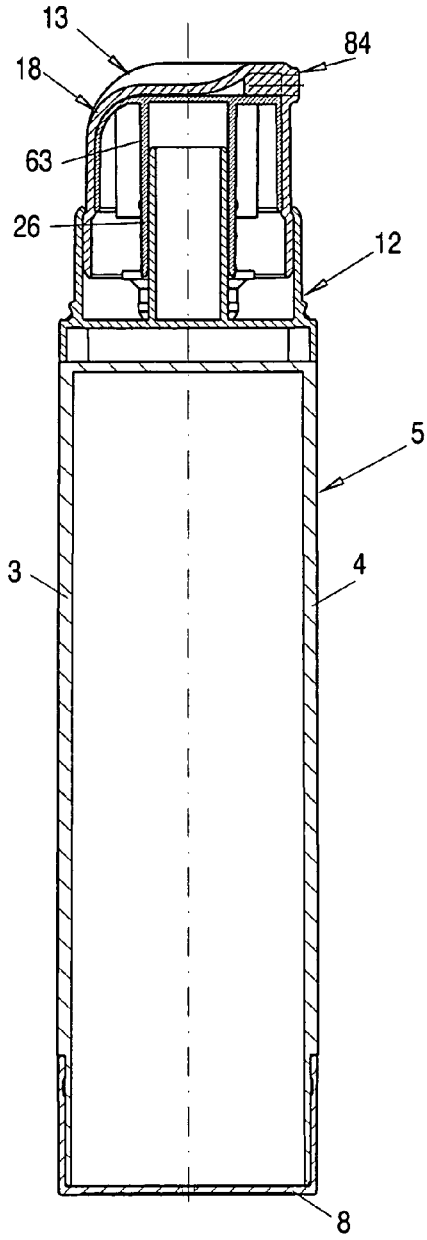
FIG. 2 is a sectional view II—II from FIG. 1.
Figure 3:
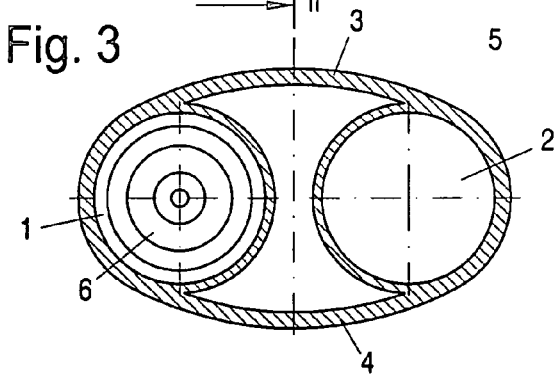
FIG. 3 is a sectional view III—III from FIG. 1.

The co-dispenser shown as a whole in FIGS. 1 and 2 has two separate storage containers 1 and 2, which have cylindrical cross sections, are arranged in parallel next to each other and are connected by two connection walls 3 and 4 to form a container housing 5 having as a whole an elliptical cross section.

Both storage containers 1 and 2 are provided with a respective follower piston 6 and 7 each, wherein the follower piston 6 is shown in its lowermost end position and the follower piston 7 in its topmost end position. However, these two follower pistons 6 and 7 shall assume the same axial position within the two storage containers 1 and 2 during the phase of use.

A common, lockingly fastened bottom cover 8, which has two ventilation openings 9 and 10, is provided as the lower cover for the two storage containers 1 and 2, which are open at the bottom.

The upper end of the container housing 5 is lockingly connected with a base body 12 of a pump head 13, which has two metering pumps 14 and 15, which are arranged in parallel next to each other and are associated with a respective storage container 1 and 2 each. These two metering pumps 14 and 15 have an identical design and can be actuated together by an upper hood body 18. Both metering pumps 14, 15 comprise a bellows 29 each as a pumping member, an outlet valve 38 and a discharge valve 55. The metering pumps 14, 15 are arranged symmetrically to the vertical axis of symmetry 21 of the container housing 5 in the pump head 13.

The hood body 18 forms the common, dimensionally stable, upper housing part of both metering pumps 14 and 15 and is guided axially movably with an expanded section 16 of an oval, axially parallel, circumferential wall 17 in a likewise oval ring wall 19 of the base body 12.

An inwardly projecting torus 20 forms here the upper stroke limitation for the hood body 18.

Figure 10:
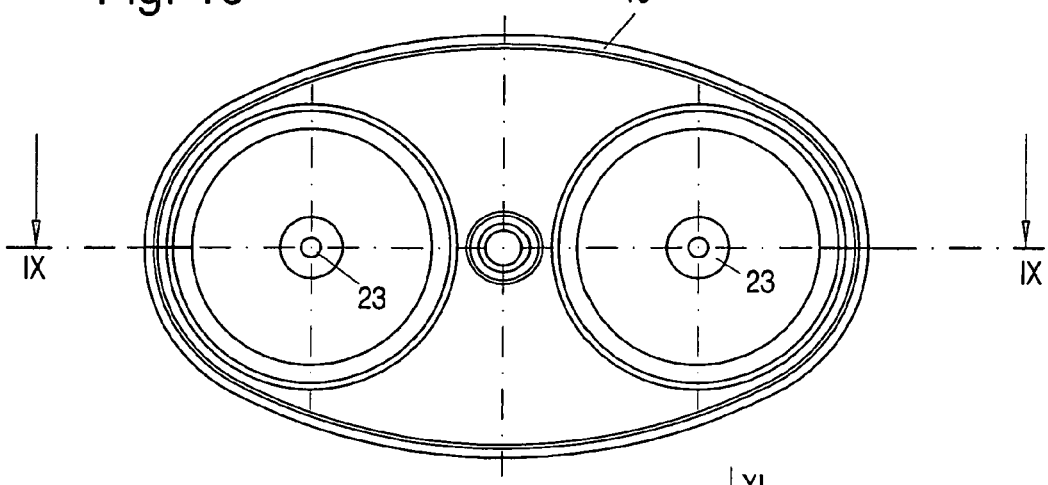
FIG. 10 is the bottom view X of the base body from FIG. 9.
Figure 9:
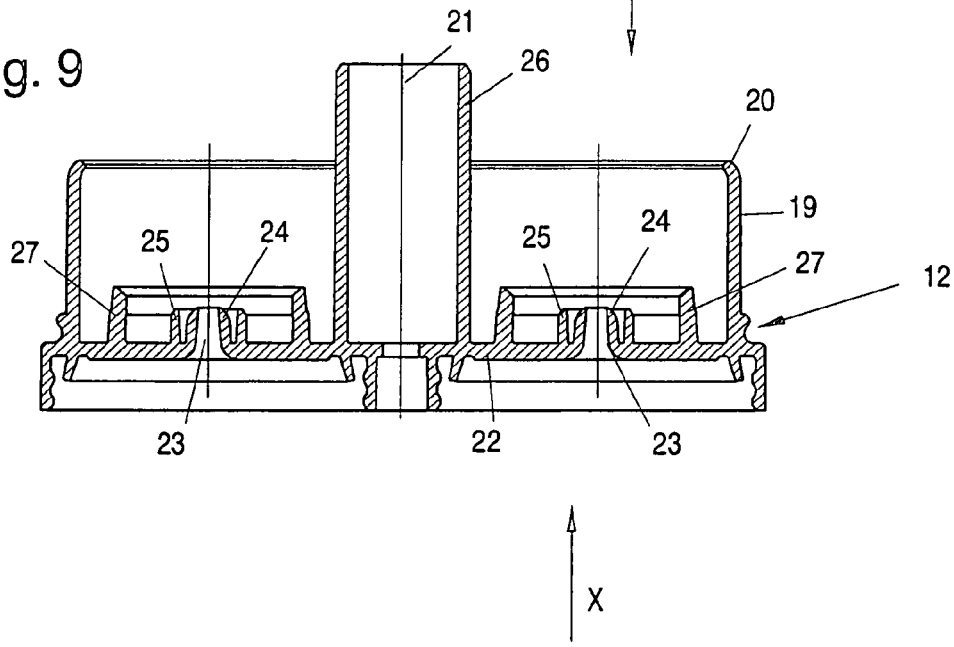
FIG. 9 is a sectional view of the base body of the pump head along the section line IX—IX in FIG. 10.
Figure 11:
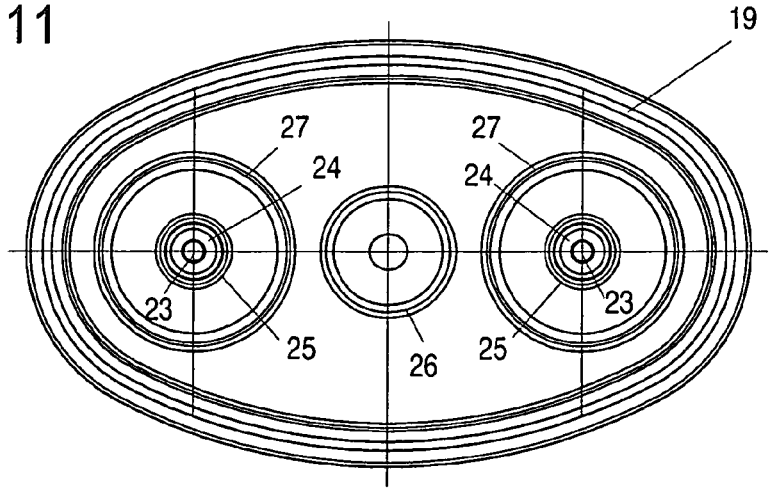
FIG. 11 is a top view XI of the base body from FIG. 9.

The base body 12, shown as an individual part in FIGS. 9 through 11, forms the dimensionally stable, lower housing part of the two metering pumps 14 and 15. A bottom wall 22, which extends at right angles to the axis of symmetry 21 and is provided with two suction openings 23 arranged symmetrically to the axis of symmetry 21, is located at the lower end of the ring wall 19 of the housing part. These suction openings 23 extend through valve seat connection pieces 24 each, which are rounded at the top on the outside and are in turn concentrically surrounded by a hollow hub 25.

A guide tube 26, which is concentric with the axis of symmetry 21 and rises above the ring wall 19, is located in the center of the bottom wall 22 of the base body 12.

Figure 8:
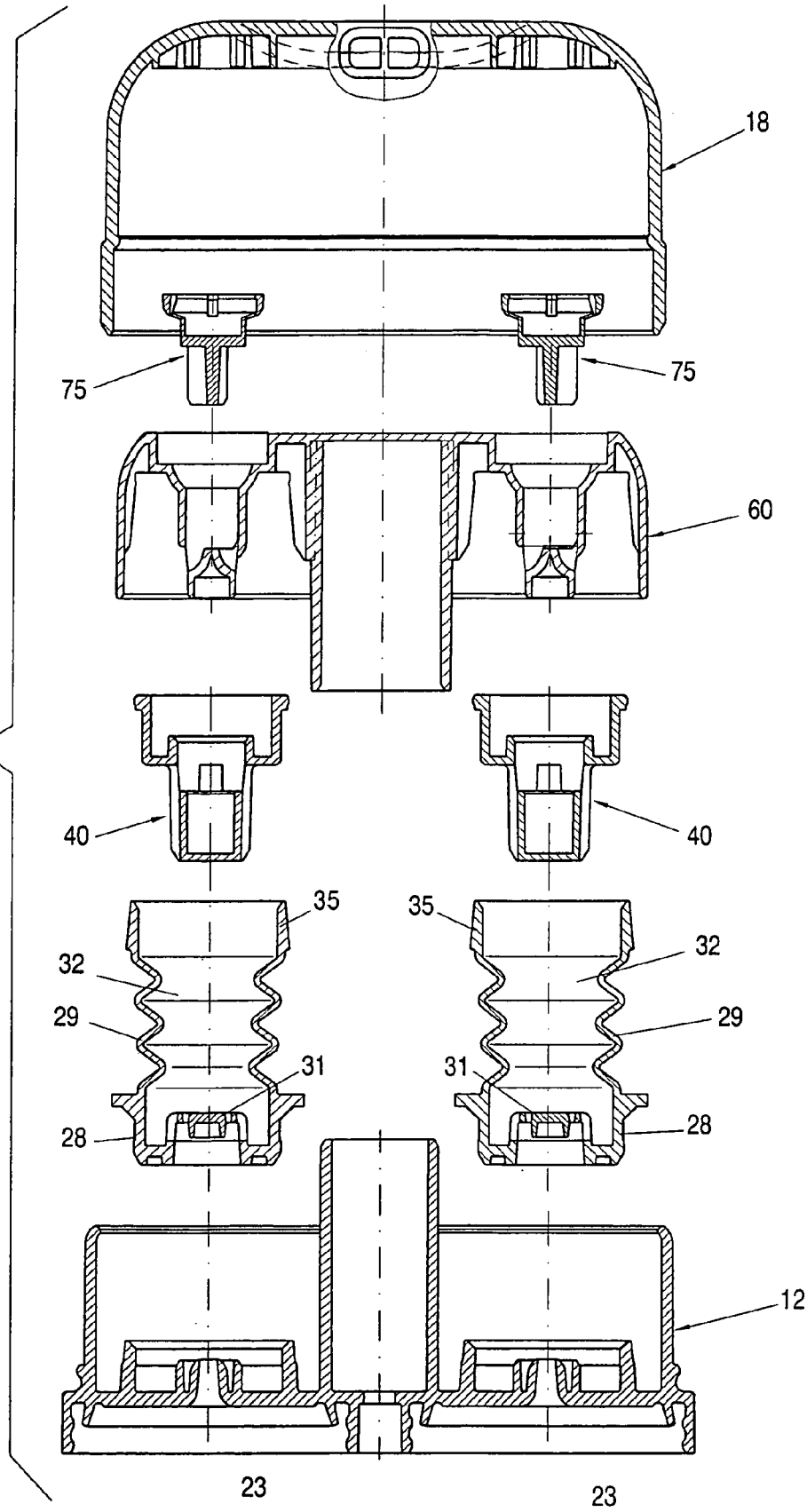
FIG. 8 is a cut-away exploded view of the individual parts of the pump head shown in FIGS. 4 and 5.

To accommodate the lower end 28 of a bellows 29 (FIG. 8) each, the bottom wall 22 is provided on the top side with two cylindrical ring type nipples 27 each, which are concentric with the discharge openings. The lower end 28 of the bellows 29 is equipped with a butterfly valve 31, which is made in one piece therewith, is held by elastic fingers 30 and is sealingly seated on the valve seat connection piece 24 and forms the suction valve 38 together with same.

The upper end of the bellows 29 is provided with a round ring collar 35, which sealingly surrounds a ring wall 36 of a displacement piston 40.

Figure 18:
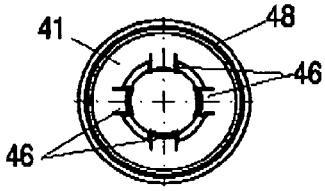
FIG. 18 is a front view XVIII from FIG. 17.
Figure 17:
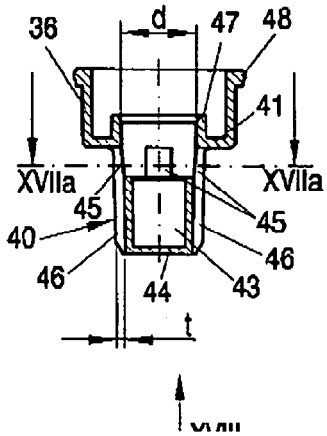
FIG. 17 is a sectional view XVII—XVII from FIG. 16.
Figure 17A:
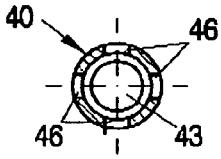
Figure 16:
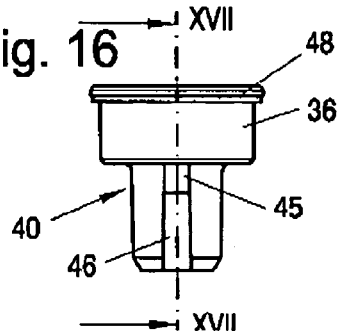
FIG. 16 is a side view of a displacement body.
Figure 21:
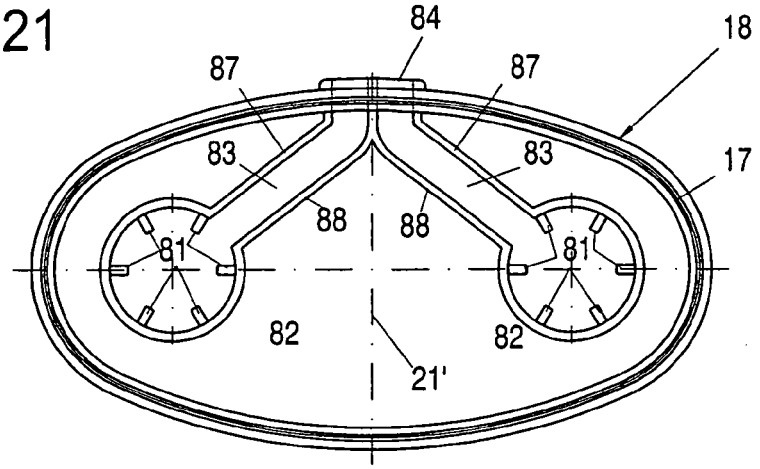
FIG. 21 is the bottom view XXI from FIG. 20.
Figure 20:
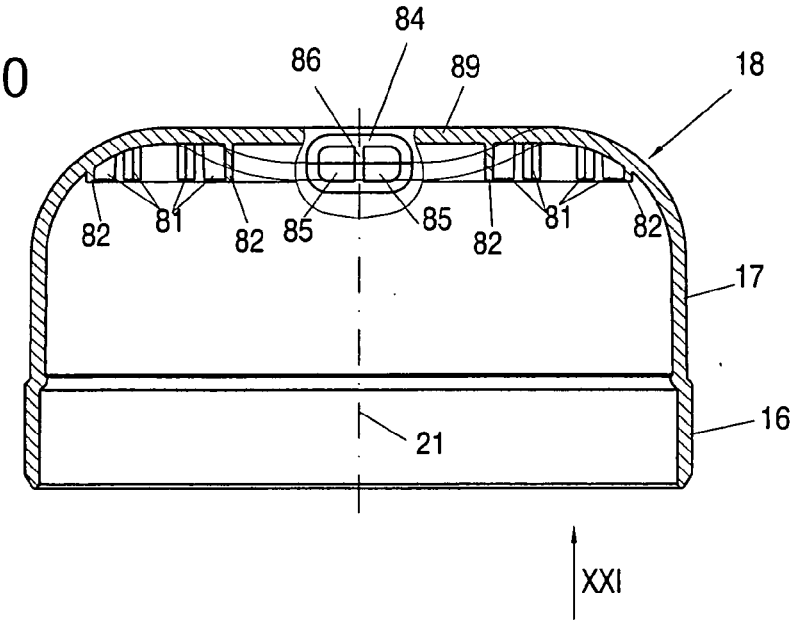
FIG. 20 is a sectional view XX—XX from FIG. 19.
Figure 19:
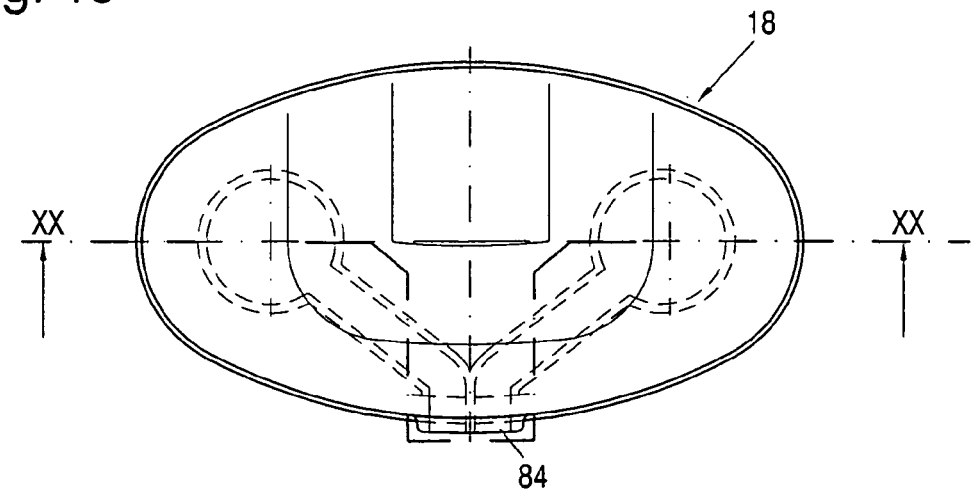
FIG. 19 is the top view of the top-side hood body of the pump head.

The displacement piston 40 shown as an individual part in FIGS. 16 through 18 is a one-piece part of a hollow body, which is designed as a separate individual part and also contains the ring wall 36. The displacement piston 40 is made integrally in one piece with an underside radial wall ring 41 of the ring wall 36. Within the ring wall 36, this radial wall ring 41 has a ring collar 47, which has approximately the same diameter as the essentially hollow cylindrical displacement piston 40. The displacement piston 40 has a cavity 43, which is open on the top side and is closed by a front wall 44 on the underside.

Directly below the radial wall ring 41, the displacement piston 40 is provided with, e.g., four radial passage openings 45, which connect the pump chamber 32 formed by the interior space of the bellows 29 with a discharge valve 55.

Figure 4:
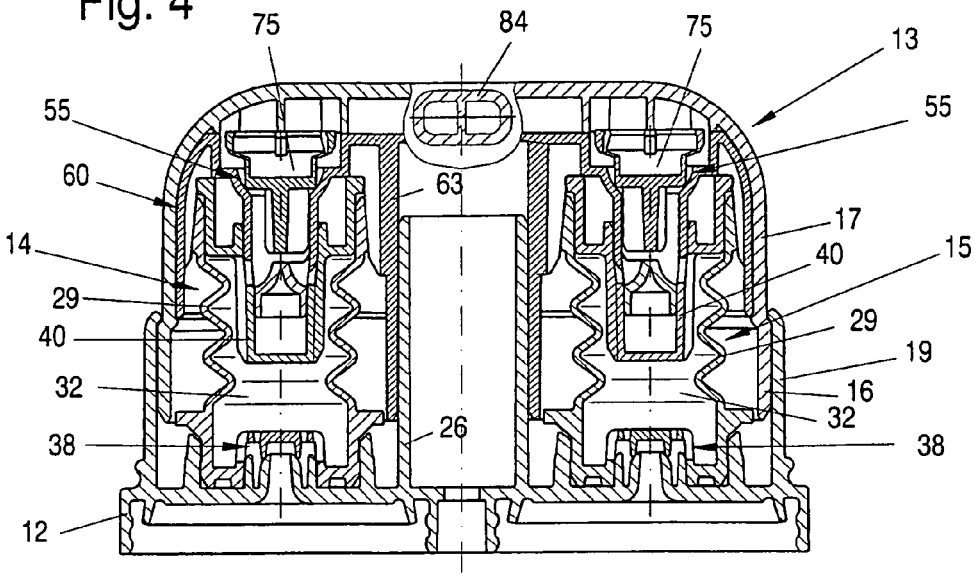
FIG. 4 is an enlarged view of the head part of the co-dispenser in the inoperative position of the two metering pumps.
Figure 5:
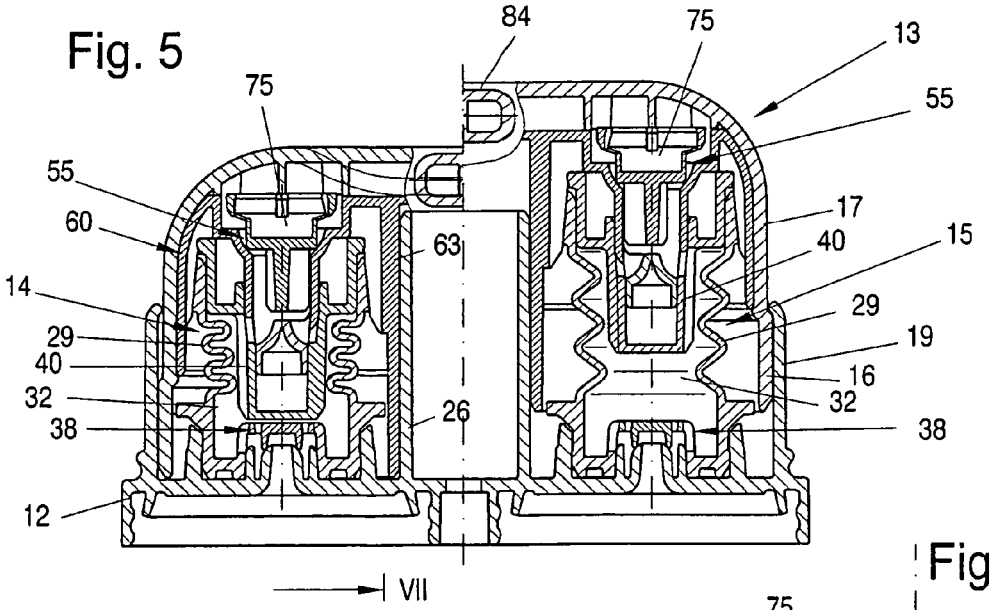
FIG. 5 is an enlarged view of the pump head of the co-dispenser with different functional positions of the two metering pumps.

These passage openings 45 are formed by four axial grooves 46, which are offset by 90° in relation to one another and are arranged on the outside at the displacement piston 40, and whose radial depth t ends within the internal diameter d of the ring collar 47. This ring collar 47 is arranged above the passage openings 45. It is used to sealingly receive a valve nipple 56 of the discharge valve 55, which said valve nipple is open at the bottom (FIGS. 4 and 5). This valve nipple 56 is a one-piece part of a valve seat housing 60, which is lockingly inserted into the hood body 18 in a positive-locking manner.

To prevent the entire cavity 43 of the displacement piston 40 from being filled with the medium to be dispensed, the valve nipple 56 is provided with a plug 57, which is connected by rib-like webs 58 in one piece with it and sealingly protrudes into the cavity 43 of the displacement piston 40 from the top. The rib-like webs 58 are arranged at the level of the passage openings 45 of the displacement piston 40, so that the medium to be dispensed can enter the interior space of the valve nipple 56 from the pump chamber 32 of the bellows 29.

The valve seat housing 60 is shown as an individual part in FIGS. 12, 13 and 14, 15. It has an oval ring wall 61, which is adapted to the oval cross-sectional shape of the hood body 18 and within which the two valve nipples 56 with the plug 57 are arranged symmetrically to the axial axis of symmetry 21. A downwardly directed guide tube 63, which can telescopically accommodate the guide tube 26 of the base body 12 and acts as an additional centering element between the two pump bodies guided movably one inside the other, is made integrally in one piece with a closed front wall 62.

Figure 14:
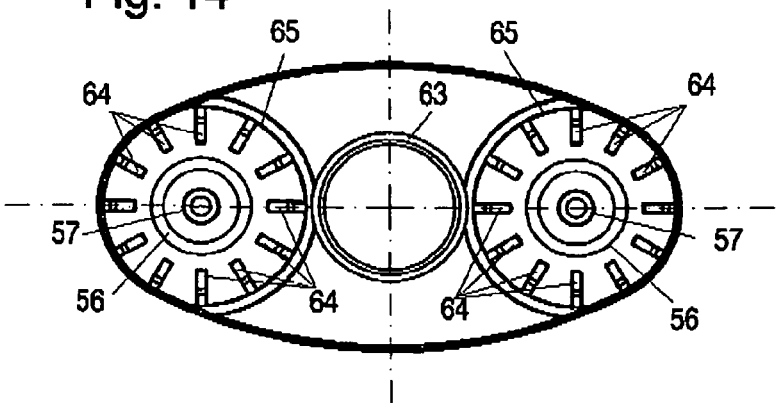
FIG. 14 is a bottom view XIV from FIG. 13.
Figure 15:
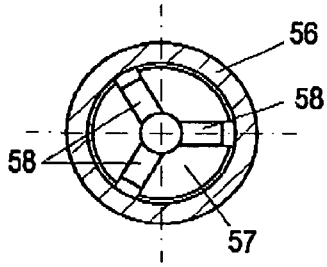
FIG. 15 is an enlarged partial view XV from FIG. 13.
Figure 13:
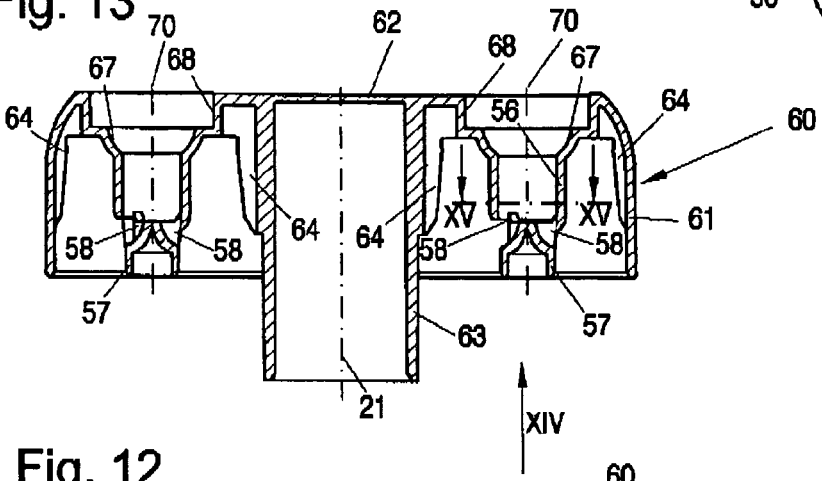
FIG. 13 is a sectional view XIII—XIII from FIG. 12.
Figure 12:
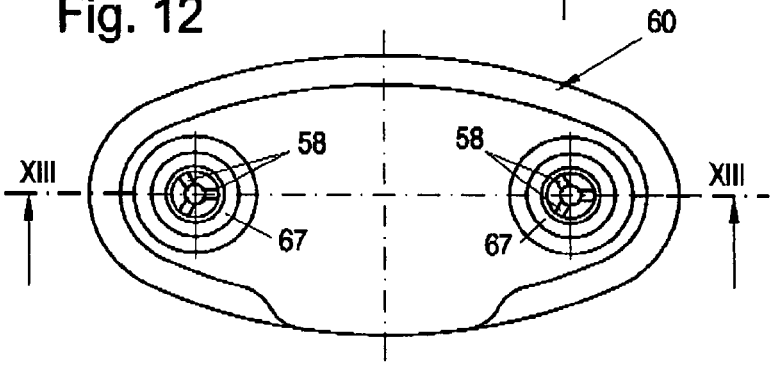
FIG. 12 is the top view of the valve seat body of the discharge valves.

As can be best recognized from FIGS. 13 and 14, the two valve nipples 55 are surrounded in a ring-like pattern by a plurality of axially extending centering ribs 64, which are made integrally in one piece with the inner side of the ring wall 61, on the one hand, and with the inner sides of two cylinder walls 65, on the other hand. These centering ribs 64 are used, on the one hand, to lockingly accommodate the ring wall 36 of the displacement piston 40, which said ring wall 36 is provided at the upper edge with an outwardly projecting torus 48. On the other hand, they are used to press the upper ring collar 35 of the bellows 29 sealingly to the ring wall 36 of the displacement piston 40.

Valve seat rings 67, which have a calotte-shaped design and are joined on the top side by cylindrical valve guide walls 68, are located at the upper ends of the valve nipples 56.

Figure 6:
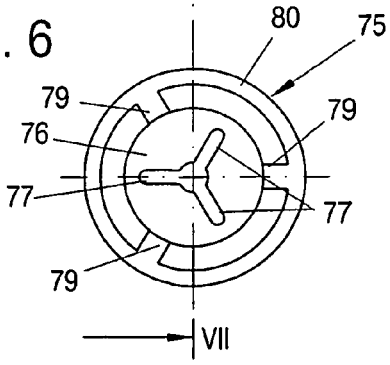
FIG. 6 is the top view of the plug of the discharge valve.
Figure 7:
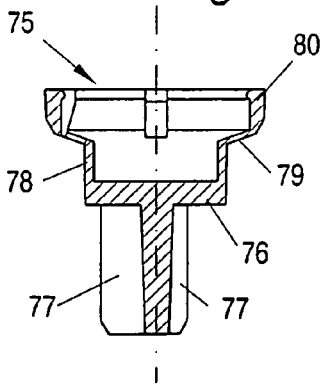
FIG. 7 is a sectional view VII—VII from FIG. 6.

A valve plug 75, which forms the movable part of the discharge valve or discharge valves 55, is mounted in the cavity enclosed by the valve nipple 56, the valve seat ring 67 and the valve seat wall 68. This valve plug 75 is shown in FIGS. 6 and 7 on a larger scale as an individual part in an underside front view and in a sectional view. It has a round closing plate 76, which lies elastically and sealingly on the calotte-shaped inner surface of the valve seat ring 67 in its inoperative position, i.e., also during the initial strokes. Three guide ribs 77, which are arranged in a star-shaped pattern and are guided in the valve nipple 56, are located on the underside of this closing plate 76. The closing plate 76 is provided on the top side with a thin ring wall 78, which is connected with a support ring 80 having a larger diameter via obliquely radial, axially elastic webs 79. This support ring 80 is supported on the top side at support ribs 81, which are arranged in a ring-like pattern and are arranged symmetrically to the axis of symmetry 70 of the valve nipple 56 and of the valve seat ring 67 and of the valve seat wall 68 on the inside of the horizontal cover wall 89 of the hood body 18 within a channel ring 82.

As is apparent from FIGS. 19 through 22, these two channel rings 82 are also arranged symmetrically to the axes of symmetry 21 and 21 'and are a one-piece part of the hood body 18. Two channels 83 extend from these channel rings 82 to a centrally arranged nozzle 84, whose two discharge openings 85 are separated from one another by a middle wall 86.

These channels 83 are formed by vertical wall elements 87 and 88, which are likewise made integrally in one piece with the inner side of the cover wall 89 and lie, together with the channel rings 82, sealingly on the top side of the front wall 62 of the valve seat housing.

Due to the new design of the displacement piston 40 according to the present invention, the mode of operation of such metering pumps, which is known per se, guarantees that no residual air cushion can be formed any longer within the pump chamber 32 formed by the cavity of the bellows 29, because the passage openings 45, through which the medium enters the discharge valve 55 from the pump chamber 32, are located in the upper end area of the bellows 29.

The air present in the bellows 29 or in the pump chamber 32 initially, i.e., before the first pump strokes, is completely removed from the pump chamber 32 and the metering pump via the discharge valve 55 by drawing in medium from the storage container 1 and 2, respectively.

It can thus be guaranteed that the medium is drawn in uniformly from the two storage containers 1 and 2 in the two metering pumps 55 having an identical design and that the quantities dispensed by the two metering pumps are equal during each pump stroke. The consequence of this is that the two storage containers will also empty uniformly and the two follower pistons 6 and 7 will always assume the same axial position corresponding to the two equal filling levels, and that, finally, the two storage containers will be pumped empty at the same time.

While a specific embodiment of the invention has been shown and described in detail to illustrate the application of the principles of the invention, it will be understood that the invention may be embodied otherwise without departing from such principles.

What is claimed is:

1. A metering pump made of plastic for the metered dispensing of liquid, gel and/or pasty media, the metering pump comprising:

a bottle container, can-container or tube-container;

a dimensionally stable lower housing part;

a dimensionally stable upper housing part telescopically movable in relation to said lower housing part, said upper housing part having a discharge opening and a ring wall having a displacement piston;

an elastic bellows arranged between said lower housing part and said upper housing part said bellows defining a pump chamber and including an upper ring collar;

a discharge channel and a discharge valve, said discharge opening being connected to said pump chamber via said discharge channel and said discharge valve, said upper ring collar of said elastic bellows sealingly surrounding said ring wall of said upper housing part with said displacement piston protruding into said bellows, said displacement piston being closed at a lower end and being provided in an upper end area of said pump chamber with at least one passage opening connecting said pump chamber with said discharge valve;

a suction valve;

a follower piston in said container, wherein said elastic bellows is connected to said container via said suction valve.

2. A metering pump in accordance with claim 1, wherein said displacement piston has a cavity that is open on a top side.

3. A metering pump in accordance with claim 1, wherein said displacement piston forms a separate cavity that is open on the top side with said ring wall surrounded by said ring collar of said bellows, said cavity having another ring collar within said ring wall above one or more passage opening for sealingly accommodating a valve nipple of said discharge valve, said valve nipple being open at a bottom.

4. A metering pump in accordance with claim 3, wherein said valve nipple has a plug, connected to said valve nipple by rib webs and sealingly protruding under said one or more passage openings into said cavity of said displacement piston.

5. A metering pump in accordance with claim 3, wherein said displacement piston is made concentrically integrally in one piece with an underside radial wall ring of the ring wall.

6. A metering pump in accordance with claim 5, wherein to form the passage opening, the displacement piston is provided on an outside with at least one axial groove having a radial depth ends radially within the internal diameter of said ring collar.

7. A metering pump in accordance with claim 6, wherein the ring wall provided with the displacement piston is provided at its upper end with a torus lockingly fastened to centering ribs, which are arranged in a ring-like pattern around the valve nipple and are a one-piece part of a valve seat housing together with the valve nipple.

8. A metering pump in accordance with claim 7, wherein the valve seat housing is lockingly inserted into a hood body in a positive-locking manner and forms the upper housing part together with same.

9. A metering pump made of plastic, the metering pump comprising:

a container;

a suction valve in communication with an inside of said container;

an elastic bellows defining a pump chamber, said pump chamber having a first end in communication with said suction valve and a second end diametrically opposite said first end, said bellows being movable between a compressed position and an expanded position;

a displacement piston arranged at said second end of said pump chamber, said piston having a first end and a diametrically opposite second end, said first end being closer to said first end of said pump chamber than said second end of said piston, said first end being closed, said piston defining a passage opening at said second end of said pump chamber, said passage opening being in communication with said pump chamber;

a discharge valve in communication with said passage opening;

a discharge channel in communication with said discharge valve;

an actuating body connected to said bellows for moving said bellows between said compressed and expanded position.

10. A metering pump in accordance with claim 9, wherein:

said displacement piston has a cavity that is open at said second end piston.

11. A metering pump in accordance with claim 9, further comprising:

a dimensionally stable lower housing part;

a dimensionally stable upper housing part telescopically movable in relation to said lower housing part, said upper housing part defining a discharge opening and a ring wall having said displacement piston, said one end of said bellows surrounding said ring wall;

said displacement piston forming a separate cavity that is open at said second end of said piston, said cavity having a ring collar within said ring wall above said passage opening for sealingly accommodating a valve nipple of said discharge valve, said valve nipple being open at a bottom.

12. A metering pump in accordance with claim 11, wherein:

said valve nipple has a plug, connected to said valve nipple by rib webs and sealingly protruding under said passage openings into said cavity of said displacement piston.

13. A metering pump in accordance with claim 11, wherein:

said displacement piston is made concentrically integrally in one piece with an underside radial wall ring of the ring wall.

14. A metering pump in accordance with claim 13, wherein:

to form the passage opening, the displacement piston is provided on an outside with an axial groove having a radial depth ending radially within an internal diameter of said ring collar.

15. A metering pump in accordance with claim 14, wherein:

said ring wall of said displacement piston is provided at its upper end with a torus lockingly fastened to centering ribs, which are arranged in a ring-like pattern around said valve nipple and are a one-piece part of a valve seat housing together with said valve nipple.

16. A metering pump in accordance with claim 15, wherein;

said valve seat housing is lockingly inserted into a hood body in a positive-locking manner and forms said upper housing part together with same.

* * * * *